US005280975A

United States Patent [19]

Tscheu et al.

[11] Patent Number: 5,280,975

[45] Date of Patent: Jan. 25, 1994

[54] LOCKING MECHANISM FOR A COVER OF A CENTRIFUGE

[75] Inventors: Wolfgang Tscheu, Henstedt-Ulzburg; Sven Ruge, Hamburg, both of Fed. Rep. of Germany

[73] Assignee: Eppendorf-Netheler-Hinz GmbH, Hamburg, Fed. Rep. of Germany

[21] Appl. No.: 742,132

[22] Filed: Aug. 8, 1991

[30] Foreign Application Priority Data

Aug. 8, 1990 [DE] Fed. Rep. of Germany ..... 4025134

[51] Int. Cl.[5] ..... B04B 7/06; E05C 3/24

[52] U.S. Cl. ..... 292/251; 494/12; 292/DIG. 69; 292/157

[58] Field of Search ..... 292/251, 341.16, 201, 292/DIG. 69, 57, 58-59, 144, 301, 157X, 160; 494/12

[56] References Cited

U.S. PATENT DOCUMENTS

| | | | |
|---|---|---|---|
| 410,807 | 9/1889 | Ruffhead | 292/58 |
| 2,587,355 | 2/1952 | McEwan | 292/157 |
| 2,787,487 | 4/1957 | Baker, Jr. | 292/58 |
| 3,439,465 | 4/1969 | DuPre | 292/160 |
| 3,633,041 | 1/1972 | Koskela | 494/12 |
| 4,012,063 | 3/1977 | Sherlock et al. | 292/DIG. 69 |
| 4,019,763 | 4/1977 | Webb, Sr. | 292/207 |
| 4,105,903 | 8/1978 | Shaw et al. | 494/12 |
| 4,345,713 | 8/1982 | Gutierrez et al. | 494/12 |
| 4,978,153 | 12/1990 | Hirsch et al. | 292/201 |
| 5,067,938 | 11/1991 | Uchida et al. | 494/12 |

FOREIGN PATENT DOCUMENTS

| | | | |
|---|---|---|---|
| 132640 | 10/1978 | Fed. Rep. of Germany | 494/12 |
| 2816395 | 10/1979 | Fed. Rep. of Germany | 494/12 |
| 3120787 | 4/1982 | Fed. Rep. of Germany | 494/12 |
| 9978 | of 1911 | United Kingdom | 292/251 |

*Primary Examiner*—Eric K. Nicholson
*Attorney, Agent, or Firm*—Dykema Gossett

[57] ABSTRACT

A mechanism for locking a cover to a housing of medium and high speed laboratory centrifuges. The locking mechanism includes an axially moveable locking member which has at least one locking portion adapted to be moved in locking engagement with a locking hole of the cover. The axially moveable locking member is rotatably mounted in the housing and connected with a rotary drive. An advancing mechanism transforms the rotary movement of the locking member into an advancing movement thereof. Preferably said advancing mechanism includes a threaded portion provided on the locking member and in engagement with a projection provided on the housing. The locking member has a portion of reduced cross section which may pass through a slot into the locking hole when the cover is moved to its closed position.

22 Claims, 6 Drawing Sheets

LOCKING MECHANISM FOR A COVER OF A CENTRIFUGE

The present invention relates to a mechanism for locking a cover to a housing of a medium or high speed laboratory centrifuge, including a locking member having an axis and being axially moveable into locking engagement with at least one locking hole of the cover.

Such locking mechanisms are known in. They generally use electrical relays. The relays are dependent on the current supply. If there is a failure in the current supply, inadvertent release of the locking mechanism may result. In locking mechanisms using magnetic means the locking condition may be maintained even in case of failure in the current supply. However, such locking mechanisms may be inadvertently released by shocks or vibrations acting on certain elements of the locking mechanism. This risk is substantial with locking mechanisms using relays of the magnetic type including spring means.

German patent application 29 07 789 discloses a locking mechanism including a rotary locking member which is actuated by manual operation or by a corresponding drive. But also this locking mechanism may be inadvertently released by vibrations or shocks acting upon a transverse pin forming a locking member.

In this connection it is to be considered that the covers of laboratory centrifuges generally are biased by spring means having the tendency to open the cover when the locking means has been released. Such spring bias is important for allowing a rapid sequence of operative steps in commercial laboratory centrifuges.

French patent application 2 524 346 discloses a locking mechanism using a solenoid. With this type of locking mechanism there is a certain risk of the locking mechanism being inadvertently released in case of failure in the current supply when a part of a broken rotor of the centrifuge will hit upon the locking mechanism.

Furthermore German application 37 27 168 discloses a locking mechanism including radially extending locking pins actuated by a rotary drive via linkage or similar means. However, also in this type of locking mechanism the cover may be inadvertently opened when the rotor of the centrifuge will break and particles of the broken rotor will hit the locking mechanism.

It is an object of the present invention to provide a locking mechanism for a cover of a medium or high speed laboratory centrifuge, which is securely maintained in its locked condition in case of failures e.g. due to breaking of the rotor of the centrifuge and in particular when the locking mechanism is subjected to shock, blow or vibration forces. Another object of the present invention is to provide a locking mechanism of minimum space requirements.

According to the present invention a mechanism for locking a cover to a housing of a medium or high speed laboratory centrifuge, including a locking member having an axis and being axially moveable into locking engagement with at least one locking hole of the cover is characterized in that said locking member is mounted in said housing so as to be rotatable by a rotary drive and includes an advancing mechanism comprising first means fixed with respect to said housing and second means on said locking member, said first and second means being in engagement with each other and one of said first and second means comprising an engagement surface inclined with respect to the axis of said locking member, and in that said locking member includes at least one portion of reduced cross-section and at least one adjacent locking portion of increased cross-section, said portion of reduced cross-section being adapted to move transversely through an entry slot into said locking hole and said locking portion of increased cross-section being adapted to be received in said locking hole for locking engagement therewith.

The rotary drive for the locking member and the advancing mechanism transforming rotary movements into axial movements of the locking member are important features of the present invention. Axial movement of the locking member avoids any misalignments of the locking member with respect to the locking hole. The first and second means of the advancing mechanism are in positive engagement with each other preventing the locking mechanism from being inadvertently released in case of failures.

Space requirements of the locking mechanism of the present invention are minimal.

Further aspects and features of preferred embodiments of the present invention are defined in the subclaims.

A preferred embodiment of the present invention will be described in more detail with respect to the accompanying drawings. In the drawings FIG. 1 is a perspective view of a laboratory centrifuge;

FIG. 2*a, b* are a partial elevation of the centrifuge showing the locking mechanism at an enlarged scale;

FIG. 3*a, b* are a partial side elevation of the locking mechanism in FIG. 2*a, b;*

In all figures same parts have been designated by the same reference numerals.

Figure 1:
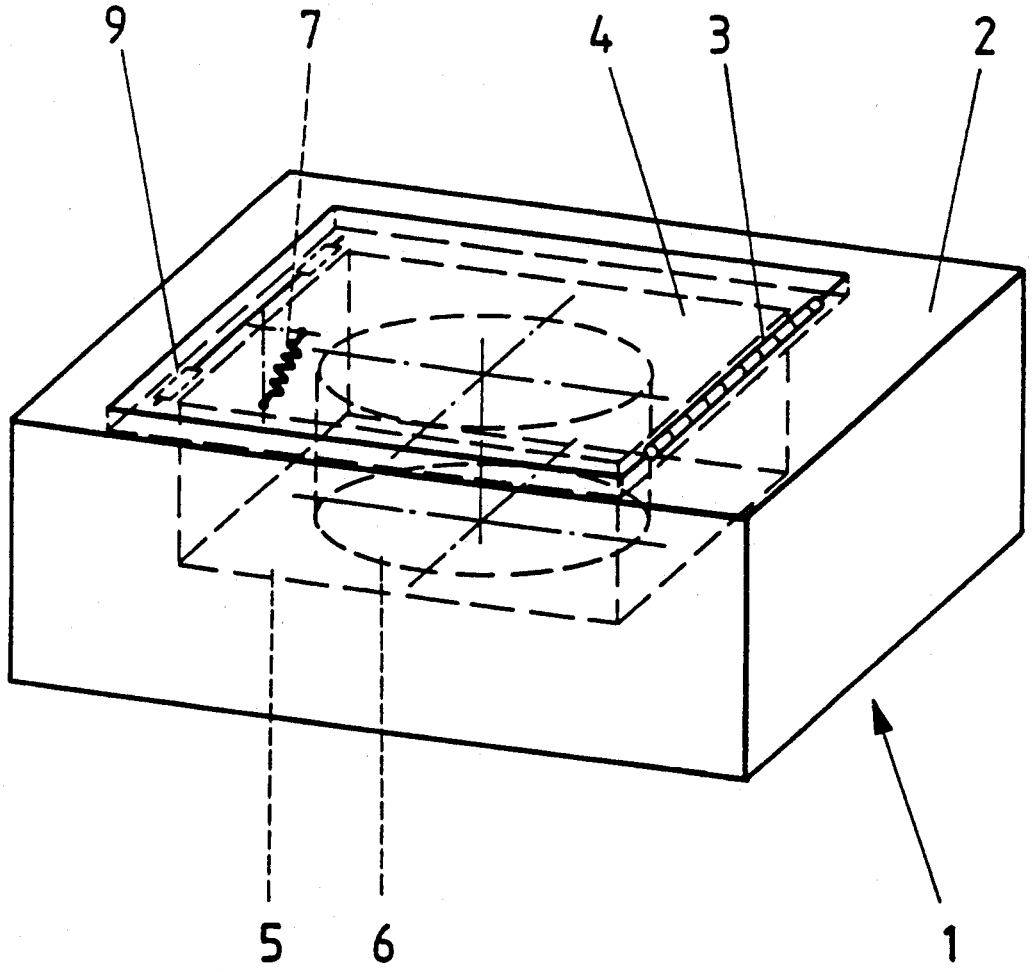

FIG. 1 discloses a laboratory centrifuge 1 including a housing 2. Housing 2 has a pivotal cover 4 hingedly connected to a top plate thereof by a hinge 3. Housing 2 includes a chamber 5 receiving a rotor 6 rotatably mounted therein. Cover 4 covers chamber 5 and is of substantial thickness as a protection against breakage of rotor 6.

Rotor 6 in chamber 5 is surrounded by side walls and a bottom wall of housing 2 and by cover 4.

It is important to lock cover 4 in its closed position against external forces and also against the force of a spring 7 disposed within chamber 5 and arranged to bias cover 4 towards its open position. Spring 7 could be replaced by a spring associated with hinge 3.

For locking cover 4 there is provided a lock mechanism 9 spaced from and opposed to hinge 3 as will be explained in more detail below.

Figure 2A:
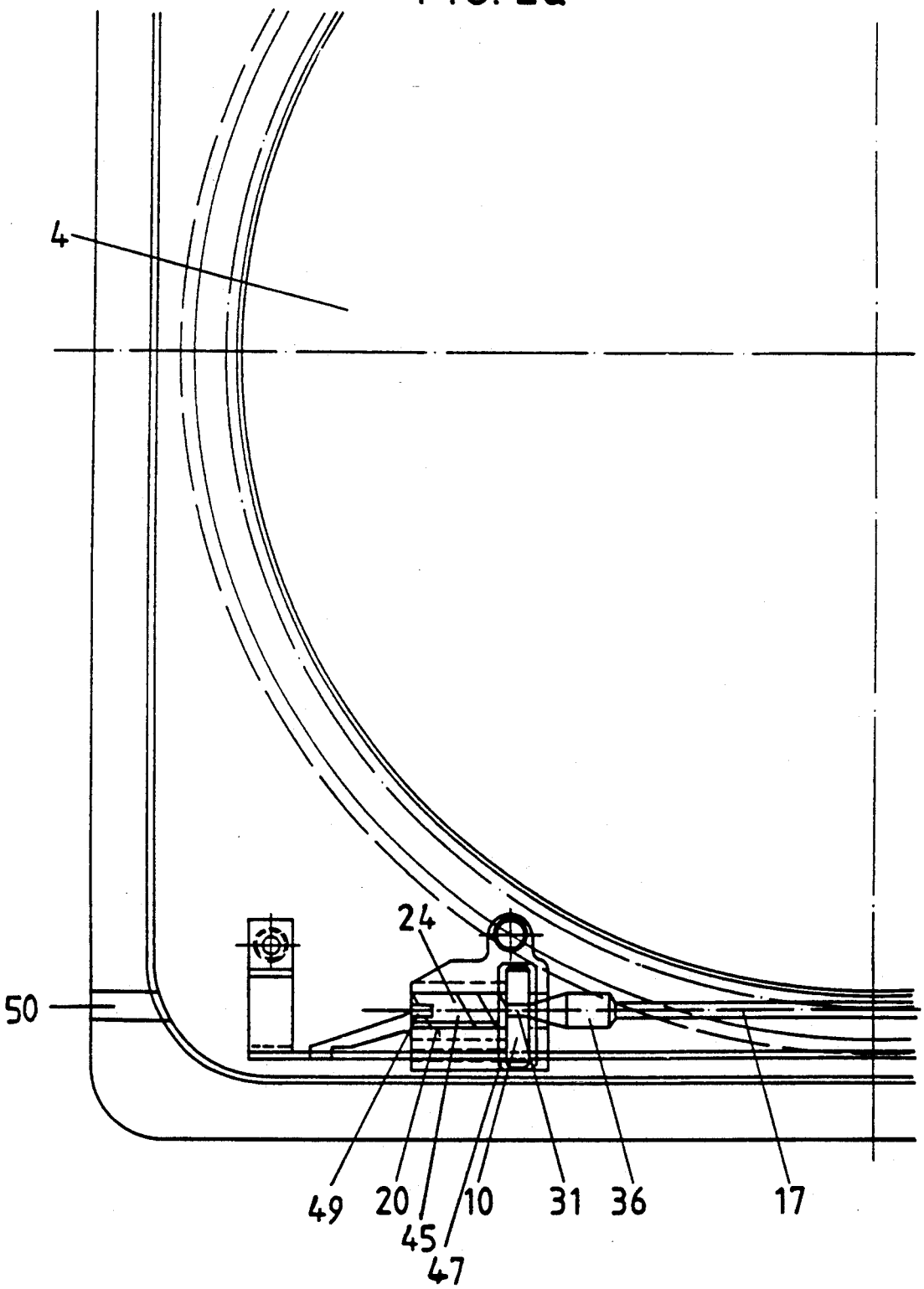
Figure 2B:
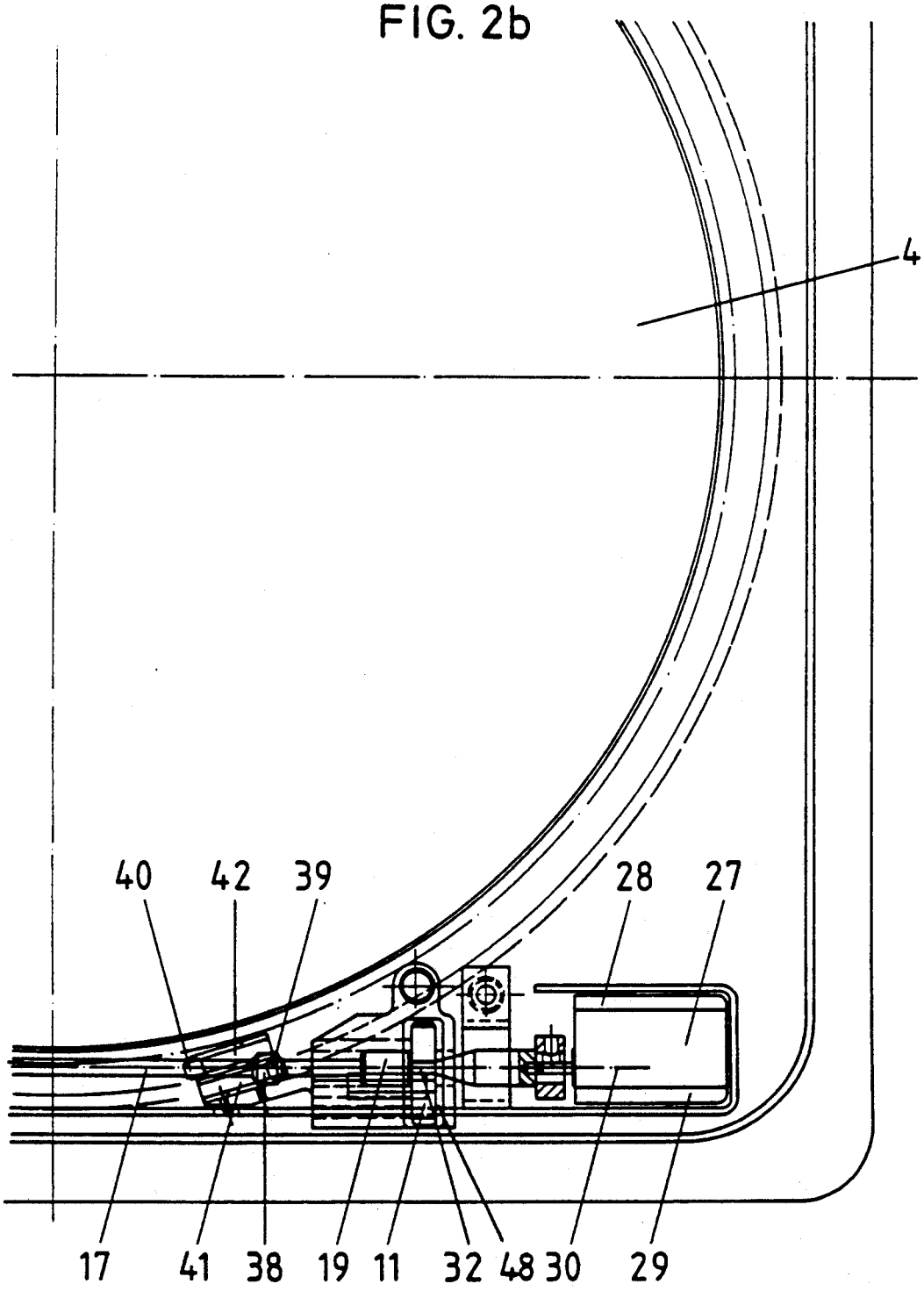
Figure 3A:
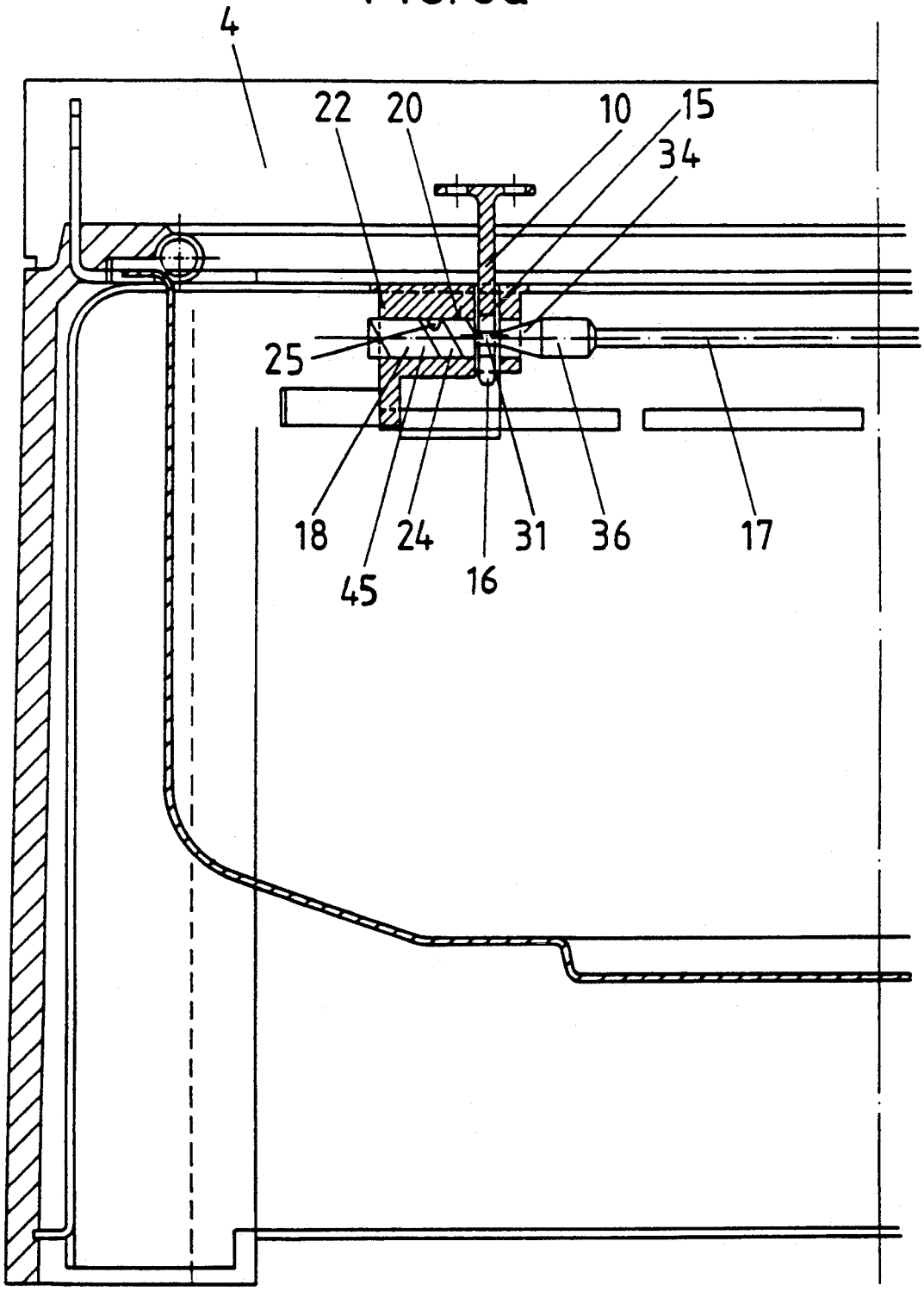
Figure 3B:
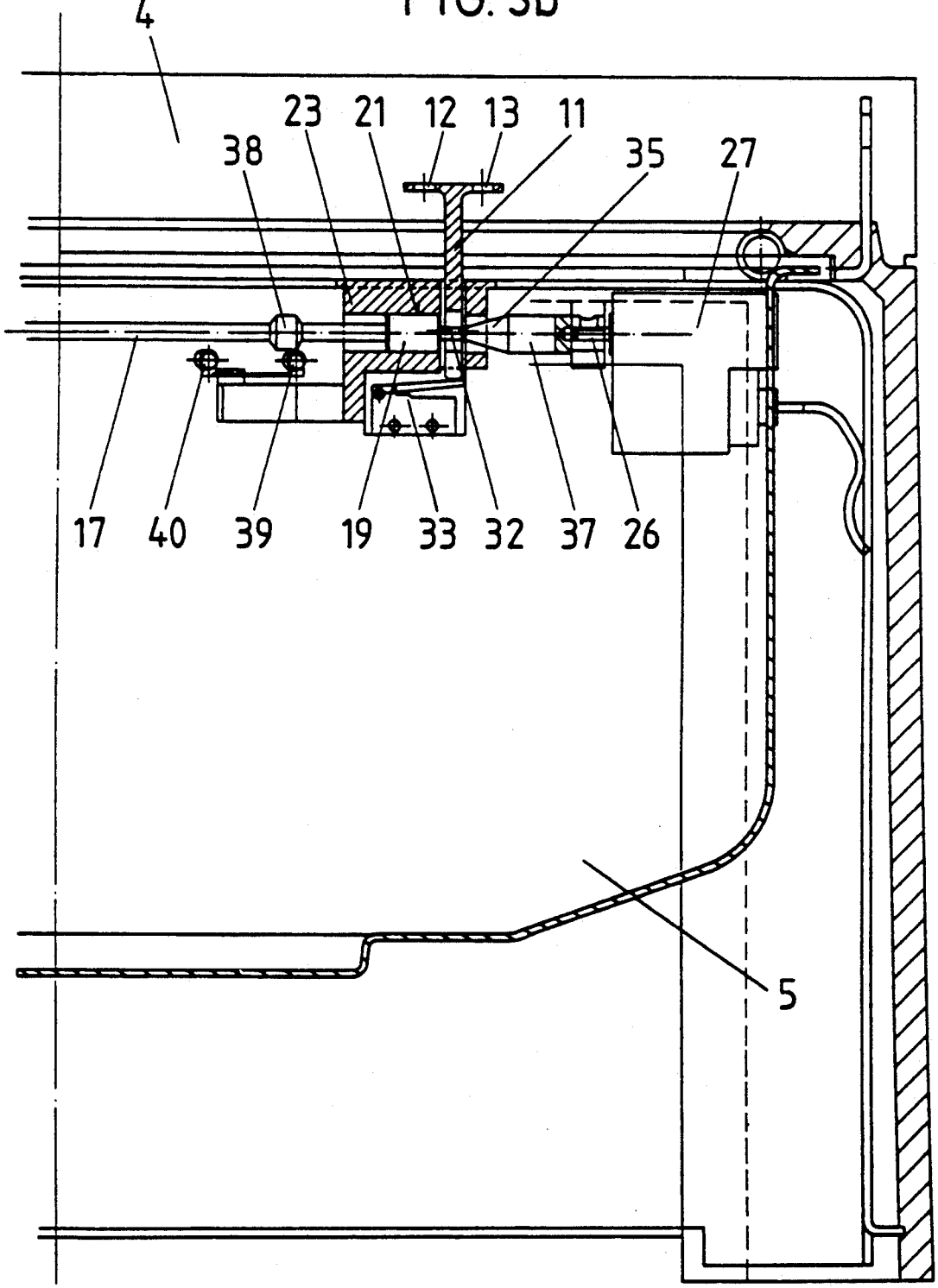

As may be seen in FIGS. 2 and 3 cover 4 includes downwardly extending lugs 10 and 11. Housing 2 includes guides 47 and 48 for receiving lugs 10 and 11 when cover 2 is moved to its closed position.

Figure 4:
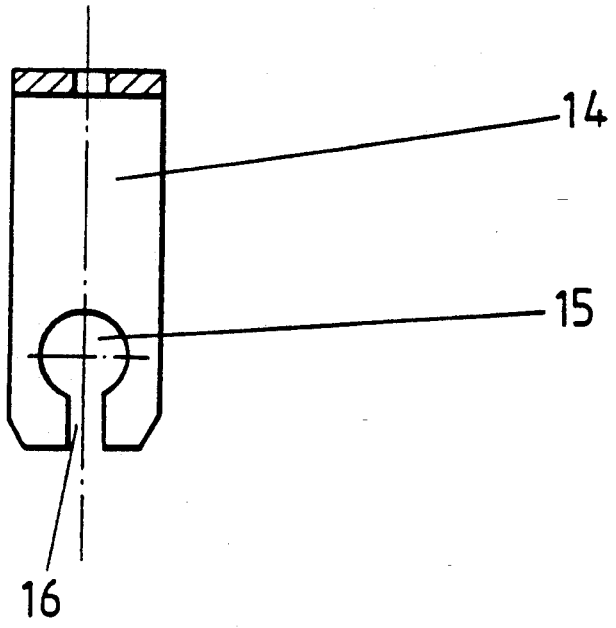
FIG. 4 is a detailed view of a lug used in the locking mechanism of the preceeding figures.

Lugs 10 and 11 which are fixed to cover 2 e.g. by bolts 12, 13 each comprise a web 14 (FIG. 4) having a circular opening 15 at its lower end. Opening 15 at its lower area opens into a slot 16 so as to be accessible from below.

Within housing 2 of the centrifuge there is slideably mounted a locking member 17 as may be seen in FIGS. 2 and 3. Locking member 17 comprises a rod member having a plurality of portions of different cross-sections along its length. In particular locking member 17 includes a central rod portion, a pair of cylindrical guide portions 18, 19, a pair of portions 31, 32 of reduced cross section, a pair of tapered conical portions 34, 35 and a pair of locking portions 36, 37 of increased cross section.

Locking member 17 has cylindrical portions 18, 19 slideably mounted in cylindrical guide bores 20, 21 in guide sleeves 22, 23 mounted in housing 2. Guide portion 19 e.g. is a cylinder having a sliding fit with guide bore 21. In a similar manner guide portion 18 has a sliding fit with guide bore 20 so that locking member 17 is moveable in an axial direction with respect to its axis.

Guide portion 18 is provided with a circumferentially and radially extending engagement surface 24 in engagement with a projection 25 provided on guide sleeve 22 which is fixed to housing 2.

Interengagement between projection 25 and engagement surface 24 provides an advancing mechanism for transforming a rotary movement of locking member 17 into an axial movement there-of. Locking member 17 has its end remote from guide portion 18 non-rotatably connected to a rotary drive comprising a gear motor 27 via a clutch 26. Motor 27 which includes a speed reducing gear is mounted in lateral guides 28, 29 so as to be non-rotatable and axially displaceable. Output shaft 30 of gear motor 27 is axially aligned with locking member 17 drivingly connected to the output shaft.

Portions 31, 32 of locking member 17 are of reduced cross section such that these portions may pass transversely through slots 16 (FIG. 4) into locking holes 15 within lugs 10, 11 of cover 4.

In operation when cover 4 is pivoted to its closed position, lugs 10, 11 enter lateral guides 47, 48 of sleeve members 22, 23, with reduced cross sectional portions 31, 32 of locking member 17 entering locking holes 15 through slots 16. At the same time lug 11 actuates a switch 33 initiating operation of motor 27 for rotating locking member 17.

Rotary movement of locking member 17 is transformed into an advancing movement thereof by interengagement of projection 25 and engagement surface 24 so that locking member 17 is moved to the left in FIGS. 2*a, b* and 3*a, b*. As a result thereof conical portions 34, 35 of locking member 17 enter into locking holes 15 (FIG. 4) while performing a certain aligning function due to their conical shape.

During further advancing movement of locking member 17 locking portions 36, 37 following conical portions 34, 35 enter into locking holes 15 so as to lock cover 4. Cylindrical locking portions 36, 37 are of a diameter such that they fit into the locking holes 15 in a locking relationship.

While locking member 17 performs its advancing movement, motor 27 moves axially together with locking member 17.

Alternatively motor 27 could be axially stationary; in this case clutch 26 would be provided with a pair of clutch halves which are axially moveable relative to each other while performing its torque transmitting function.

Locking member 17 is provided with a switch control portion 38 of increased cross section. In response to the position of locking member 17 control portion 38 operates one 39 or the other 40 actuating member of a pair of limit switches 41, 42. Limit switches 41, 42 are inclined with respect to the axis of locking member 17 so that its actuating members 39, 40 are in a plane intersecting the axis of locking member 17. This enables switch control portion 38 to engage either one of actuating members 39, 40 of limit switches 41, 42 so as to control operation of motor 27. The spacing between actuating members 39, 40 is dimensioned so that the motor 27 is deactivated when either portions 31, 32 of reduced cross section or locking portions 36, 37 are within locking holes 15 of lugs 10, 11.

In FIGS. 2*a, b* and 3*a, b* engagement surface 24 forms part of a threaded portion of a spindle 45 which is comprised of guide portion 18. Engagement surface 24 could extend for only a fraction of the circumference of portion 18, e.g. for 25°. Engagement surface 24 and projection 25 could be in the form of a bayonet-type connection.

Figure 5:
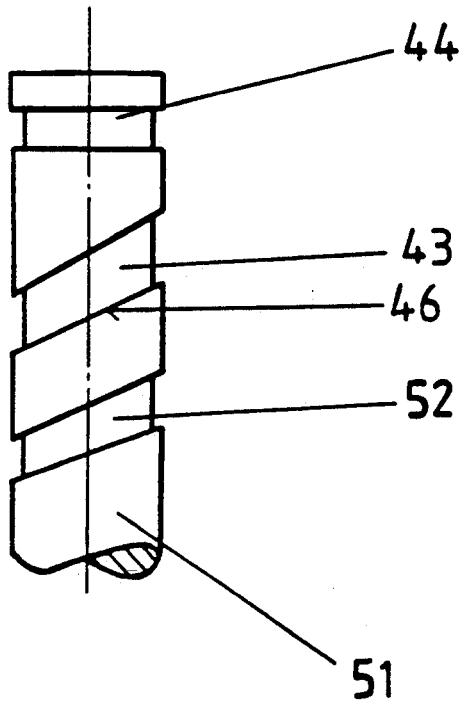
FIG. 5 is a partial view of a locking portion of the locking member.

FIG. 5 shows an alternative type of engagement surface provided in the guide portion. In this case the guide portion is comprised of a spindle 51 having threaded portions 52, 53 of different pitches. At the end of threaded portions 52, 53 there is provided a thread 44 of zero pitch for ensuring secure locking engagement. Threaded portions 52, 43 form engagement surface 46.

As is shown in FIG. 2*a* locking member 17 is provided with profiled means comprised of a slot 49 in its end face adjacent guide portion 18. Axially aligned with locking member 17 is an access opening 50 in the wall of the housing 2 which allows to have a manual tool engage slot 49 in the end face of locking member 17. During normal operation access opening 50 is closed by a removeable closure (not shown). If there is failure e.g. in the current supply the closure (not shown) is removed from access opening 50, and a manual tool is moved into engagement with slot 49 through access opening 50 for manual release of the locking mechanism.

What is claimed is:

1. A mechanism for locking a cover to a housing of a medium or high speed laboratory centrifuge, including a locking member having an axis and being axially moveable into locking engagement with at least one circular locking hole of the cover, characterized in that said locking member (17) is mounted in said housing (2) so as to be rotatable by a rotary drive (27) and includes an advancing mechanism comprising first means (25) fixed with respect to said housing (2) and second means (24) on said locking member (17), said first and second means being in engagement with each other and one of said first and second means comprising an engagement surface (46) inclined with respect to the axis of said locking member (17), and in that said locking member (17) includes at least one portion (31; 32) of reduced cross-section and at least one adjacent cylindrical locking portion (36; 37) of increased cross-section, said portion of reduced cross-section being adapted to move transversely through an entry slot (16) opening into said locking hole (15) and said cylindrical locking portion (36; 37) of increased cross-section being adapted to be received in said circular locking hole (15) for locking engagement therewith.

2. The locking mechanism of claim 1, wherein said locking member (17) is adapted to be in locking engagement with said cover (4) at two locations.

3. The locking mechanism of claim 1, wherein said engagement surface of said advancing mechanism comprises a threaded portion having an axial pitch.

4. The locking mechanism of claim 1, wherein said advancing mechanism comprises a bayonet type drive connection between said first and second means.

5. The locking mechanism of claim 2, wherein two locking holes (15) are provided on the cover (4) and two locking portions (36, 37) are provided on the locking member (17).

6. The locking mechanism of claim 3, wherein said threaded portion extends for at least 30° in the circumferential direction of said rotatable locking member (17).

7. The locking mechanism of claim 3 wherein said threaded portion has a plurality of threads.

8. The locking mechanism of claim 7, wherein said threaded portion is provided on said locking member (17) and comprises a spindle (45, 51).

9. The locking mechanism of claim 8, wherein said spindle (45, 51) has portions of different pitches along its length.

10. The locking mechanism of claim 9, wherein said threaded portion has a thread (44) of zero pitch at one end to define to a locking position of the locking member (17).

11. The locking mechanism of claim 1, wherein the locking member (17) includes a tapered portion (34; 35) adjacent said locking portion (36; 37) so as to facilitate entry of said locking portion (36; 37) into said locking hole (15).

12. The locking mechanism of claim 1, wherein said rotary drive comprises a gear motor (27) providing a substantial speed reduction.

13. The locking mechanism of claim 12, wherein said locking member (17) is axially aligned with an output shaft of said gear motor (27).

14. The locking mechanism of claim 12, wherein said gear motor (27) is fixedly connected to said locking member (17) and is mounted in said housing (2) so as to be axially moveable with said locking member (17).

15. The locking mechanism of claim 12, wherein said gear motor (27) is stationary with respect to said housing (2) and is connected to said locking member (17) by a torque clutch (26) including a pair of clutch halves axially moveable with respect to each other.

16. The locking mechanism of claim 1, wherein said at least one locking hole (15) is provided on a lug (10, 11) extending from the cover (4), said casing (2) including lateral guides (47, 48) for receiving said lug (10; 11) when said locking member (17) is in locking engagement with the cover (4).

17. The locking mechanism of claim 1, wherein said locking member (17) includes cylindrical guide portions (18, 19) adapted to be guidingly received in guide sleeves (22, 23) provided on said housing (2).

18. The locking mechanism of claim 8, wherein one (18) of said guide portions comprises said spindle (45).

19. The locking mechanism of claim 1, wherein a pair of limit switches (41, 42) and a switch control member (38) are provided on said casing and said locking member (17), respectively, and said limit switches (41, 42) have axes inclined to the axis of the locking member (17) and include actuating members (39, 40) disposed in a plane intersecting the axis of the locking member.

20. The locking mechanism of claim 1 including a trip switch (33) provided in said housing (2) and adapted to be operated by a portion (11) of the cover (4) when the cover is moved to its closed position.

21. The locking mechanism of claim 1 including manual means for releasing the locking mechanism, said manual means comprising profiled means (49) on one end of the locking member (17) or on a shaft of said rotary drive of the locking member (17) , and a closeable access opening (50) in a wall of said housing (2) allowing to move a manual tool into engagement with said profiled means.

22. The locking mechanism of claim 21, wherein the profiled means (49) are provided on the shaft of the motor for the locking member.

* * * * *